US007303847B2

(12) United States Patent
Tomita et al.

(10) Patent No.: US 7,303,847 B2
(45) **Date of Patent: *Dec. 4, 2007**

(54) DRY TONER

(75) Inventors: Masami Tomita, Numazu (JP); Toshiki Nanya, Mishima (JP); Shigeru Emoto, Numazu (JP); Shinichiro Yagi, Numazu (JP); Hiroshi Yamada, Numazu (JP); Naohiro Watanabe, Shizuoka-ken (JP); Tadao Takigawa, Shinshiro (JP)

(73) Assignee: Ricoh Company Limited, Yokohama-shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/724,150

(22) Filed: Dec. 1, 2003

(65) Prior Publication Data

US 2004/0157146 A1 Aug. 12, 2004

(30) Foreign Application Priority Data

Nov. 29, 2002 (JP) ..... 2002-347478

(51) Int. Cl.
*G03G 9/09* (2006.01)

(52) U.S. Cl. ..... 430/108.9; 430/109.4; 430/110.3; 430/137.19; 430/123.57

(58) Field of Classification Search ..... 430/108.9, 430/109.4, 110.3, 110.4, 137.1, 137.17, 137.19, 430/126, 123.57, 123.54; 399/252, 119
See application file for complete search history.

(56) References Cited

U.S. PATENT DOCUMENTS 5,418,108 A 5/1995 Kmiecik-Lawrynowicz et al.
5,430,526 A * 7/1995 Ohkubo et al. ..... 399/159
5,547,802 A * 8/1996 Kawase et al. ..... 430/108.24
5,738,966 A 4/1998 Okuno et al. ..... 430/108.3
6,080,519 A * 6/2000 Ishiyama et al. ..... 430/110.3
6,326,115 B1 * 12/2001 Nakanishi et al. ..... 430/109.5
6,395,443 B2 5/2002 Kuroda et al. ..... 430/110.4
6,593,048 B2 7/2003 Sasaki et al. ..... 430/106.1
6,740,460 B2 * 5/2004 Tomita et al. ..... 430/109.4
6,824,945 B2 * 11/2004 Emoto et al. ..... 430/137.15

(Continued)

FOREIGN PATENT DOCUMENTS

EP 1 205 813 5/2002

(Continued)

OTHER PUBLICATIONS

Japanese Patent Office machine-assisted translation of JP 06-175403 (pub. Jun. 1994).*

(Continued)

*Primary Examiner*—Janis L. Dote
(74) *Attorney, Agent, or Firm*—Oblon, Spivak, McClelland, Maier & Neustadt, P.C.

(57) ABSTRACT

A dry toner is provided that is prepared by a method including the steps of (A) dissolving or dispersing a toner composition in an organic solvent to prepare a toner composition liquid and (B) dispersing the toner composition liquid in an aqueous liquid which contains a binder resin formed of a modified polyester (i) and a colorant containing a carbon black having a pH not greater than 7, wherein the toner has a volume average particle diameter (Dv) is from 3 to 7 μm and a ratio of the volume average particle diameter (Dv) to a number average particle diameter (Dp) is from 1.00 to 1.25.

12 Claims, 2 Drawing Sheets

U.S. PATENT DOCUMENTS

| | | | | |
|---|---|---|---|---|
| 6,835,520 | B2 * | 12/2004 | Bando et al. | 430/124 |
| 6,849,369 | B2 * | 2/2005 | Yagi et al. | 430/110.4 |
| 6,852,462 | B2 * | 2/2005 | Emoto et al. | 430/109.4 |
| 7,005,223 | B2 | 2/2006 | Yamashita et al. | 430/108.3 |
| 7,005,480 | B2 | 2/2006 | Kinsho et al. | 525/390 |
| 7,056,636 | B2 * | 6/2006 | Tomita et al. | 430/108.4 |
| 7,056,638 | B1 * | 6/2006 | Tomita et al. | 430/108.8 |
| 2003/0104297 | A1 * | 6/2003 | Matsuda et al. | 430/108.3 |
| 2003/0125479 | A1 | 7/2003 | Kinsho et al. | 525/390 |
| 2003/0138717 | A1 * | 7/2003 | Yagi et al. | 430/110.4 |
| 2004/0142265 | A1 * | 7/2004 | Tomita et al. | 430/108.4 |

FOREIGN PATENT DOCUMENTS

| | | | |
|---|---|---|---|
| EP | 1 239 334 | A1 | 9/2002 |
| EP | 1 243 976 | | 9/2002 |
| JP | 57-109825 | | 7/1982 |
| JP | 06-175403 | * | 6/1994 |
| JP | 06-289652 | | 10/1994 |
| JP | 07-056390 | | 3/1995 |
| JP | 09-034167 | | 2/1997 |
| JP | 09-043909 | | 2/1997 |
| JP | 11-133665 | | 5/1999 |
| JP | 11-133666 | | 5/1999 |
| JP | 11-133667 | | 5/1999 |
| JP | 11-149179 | | 6/1999 |
| JP | 11-149180 | | 6/1999 |
| JP | 2002-284881 | | 10/2002 |
| JP | 2002-357929 | | 12/2002 |
| WO | WO 01/60893 | A1 | 8/2001 |
| WO | WO 02/056116 | A1 | 7/2002 |

OTHER PUBLICATIONS

USPTO English-language translation of JP 06-175403 (pub. Jun. 1994).*

Diamond, A.S., ed., *Handbook of Imaging Materials*, Marcel Dekker, NY (1991), pp. 168-169.*

Patent Abstract of Japan English-language abstract describing published Japanese Patent Application 2002-287400(pub. Oct. 2002) and Japanese Patent Office machine-assisted translation of claims of Japanese Patent Application 2002-287400.*

Patent Abstract of Japan English-language abstract describing published Japanese Patent Application 2002-287421 (pub. Oct. 2002) and Japanese Patent Office machine-assisted translation of claims of Japanese Patent Application 2002-287421.*

Patent Abstract of Japan English-language abstract describing published Japanese Patent Application 2002-221812(pub. Aug. 2002) and Japanese Patent Office machine-assisted translation of claims of Japanese Patent Application 2002-221812.*

Patent Abstract of Japan English-language abstract describing published Japanese Patent Application 2000-338709 (pub. Dec. 2000) and Japanese Patent Office machine-assisted translation of claims of Japanese Patent Application 2000-338709.*

Patent Abstract of Japan English-language abstract describing published Japanese Patent Application 2000-172005 (pub. Jun. 2000) and Japanese Patent Office machine-assisted translation of claims of Japanese Patent Application 2002-172005.*

Patent Abstract of Japan English-language abstract describing published Japanese Patent Application 07-146588(pub. Jun. 1995) and Japanese Patent Office machine-assisted translation of claims of Japanese Patent Application 07-146588.*

Patent Abstract of Japan English-language abstract describing published Japanese Patent Application 2002-049220 (pub. Feb. 2002) and Japanese Patent Office machine-assisted translation of claims of Japanese Patent Application 2002-049220.*

U.S. Appl. No. 10/286,791, filed Nov. 4, 2002, Sugiyama et al.
U.S. Appl. No. 10/247,639, filed Sep. 20, 2002, Sugiyama et al.
U.S. Appl. No. 10/305,191, filed Nov. 27, 2002, Uchinokura et al.
U.S. Appl. No. 10/244,526, filed Sep. 17, 2002, Sugiyama et al.
U.S. Appl. No. 10/246,601, filed Sep. 19, 2002, Emoto et al.
U.S. Appl. No. 10/394,265, filed Mar. 24, 2003, Nanya et al.
U.S. Appl. No. 10/252,070, filed Sep. 23, 2002, Aoki et al.
U.S. Appl. No. 10/158,069, filed May 31, 2002, Matsuda et al.
U.S. Appl. No. 10/151,103, filed May 21, 2002, Kondo et al.
U.S. Appl. No. 10/284,177, filed Oct. 31, 2002, Sugiyama et al.
U.S. Appl. No. 10/286,816, filed Nov. 4, 2002, Emoto et al.
U.S. Appl. No. 10/112,769, filed Apr. 2, 2002, Sugiyama et al.
U.S. Appl. No. 10/188,049, filed Jul. 3, 2002, Sugiyama et al.
U.S. Appl. No. 10/188,753, filed Jul. 5, 2002, Emoto et al.
U.S. Appl. No. 09/964,622, filed Sep. 28, 2001, Nanya et al.
U.S. Appl. No. 10/114,056, filed Apr. 3, 2002, Fushimi et al.
U.S. Appl. No. 10/092,920, filed Mar. 8, 2002, Yamashita.
U.S. Appl. No. 10/098,556, filed Mar. 18, 2002, Sugiyama et al.
U.S. Appl. No. 10/020,925, filed Dec. 19, 2001, Mochizuki et al.
U.S. Appl. No. 09/986,023, filed Nov. 07, 2001, Sugiyama et al.
U.S. Appl. No. 09/905,872, filed Jul. 17, 2001, Sasaki et al.
U.S. Appl. No. 10/607,014, filed Jun. 27, 2003, Tomita et al.
U.S. Appl. No. 10/250,667, filed Jul. 7, 2003, Emoto et al.
U.S. Appl. No. 10/645,804, filed Aug. 22, 2003, Tomita et al.
U.S. Appl. No. 10/670,320, filed Sep. 26, 2003, Watanabe et al.
U.S. Appl. No. 10/680,246, filed Oct. 8, 2003, Sugiyama et al.
U.S. Appl. No. 10/681,185, filed Oct. 9, 2003, Sugiyama et al.
U.S. Appl. No. 10/724,260, filed Dec. 1, 2003, Emoto et al.
U.S. Appl. No. 10/707,000, filed Nov. 14, 2003, Tomita et al.
U.S. Appl. No. 10/712,026, filed Nov. 14, 2003, Tomita et al.
U.S. Appl. No. 10/921,993, filed Aug. 20, 2004, Amemiya et al.
U.S. Appl. No. 10/960,084, filed Oct. 8, 2004, Yamada et al.
U.S. Appl. No. 10/959,663, filed Oct. 7, 2004, Sugiura et al.
U.S. Appl. No. 10/969,076, filed Oct. 21, 2004, Uchinokura et al.
U.S. Appl. No. 11/016,964, filed Dec. 21, 2004, Ohki et al.
U.S. Appl. No. 11/100,813, filed Apr. 7, 2005, Ojimi et al.
U.S. Appl. No. 11/226,357, filed Sep. 15, 2005, Tanaka et al.
U.S. Appl. No. 11/229,748, filed Sep. 20, 2005, Yamashita et al.
U.S. Appl. No. 11/224,976, filed Sep. 14, 2005, Inoue et al.
U.S. Appl. No. 11/298,583, filed Dec. 12, 2005, Tomita et al.
U.S. Appl. No. 11/313,817, filed Dec. 22, 2005, Inoue et al.
U.S. Appl. No. 11/289,488, filed Nov. 30, 2005, Shimojo et al.
U.S. Appl. No. 11/513,175, filed Aug. 31, 2006, Ohki et al.
U.S. Appl. No. 11/512,385, filed Aug. 30, 2006, Tomita.
U.S. Appl. No. 11/519,893, filed Sep. 13, 2006, Inoue et al.
U.S. Appl. No. 11/608,521, filed Dec. 8, 2006, Satoru et al.
U.S. Appl. No. 11/685,969, filed Mar. 14, 2007, Uchinokura et al.
U.S. Appl. No. 11/685,872, filed Mar. 14, 200, Uchinokura et al.
U.S. Appl. No. 11/734,895, filed Apr. 13, 2007, Yamashita et al.

* cited by examiner

DRY TONER

BACKGROUND OF THE INVENTION

1. Field of the Invention

The present invention relates to a dry toner for developing an electrostatic image in electrophotography, electrostatic recording, electrostatic printing and the like, a developer including the dry toner, and a process cartridge, an image forming method using the developer and an image forming apparatus using the developer. More particularly the present invention relates to a dry toner for use in copiers, laser printers and plain-paper facsimile machines and similar devices which use a direct or indirect electrophotographic development method, a developer, and a process cartridge, an image forming method and an image forming apparatus using the toner.

2. Discussion of the Background

Electrostatic latent images, which are formed on an image bearing member using a method such as electrophotography, electrostatic recording and electrostatic printing are developed with a toner in order to be visualized.

For example, visual images are typically formed as follows:

(1) a latent electrostatic image is formed on an image bearing member such as photoreceptors (latent image forming process);

(2) the latent electrostatic image is developed with a developer including a toner to form a toner image on the image bearing member (developing process);

(3) the toner image is transferred onto a receiving material, such as paper, optionally via an intermediate transfer medium (transfer process);

(4) the toner image on the receiving material is fixed upon application of heat, etc. to form a hard copy (fixing process).

As a developer for developing an electrostatic image formed on the surface carrying a latent image thereon, there are known two component developers containing a carrier and a toner, and single component toners requiring no carrier (a magnetic toner and a non-magnetic toner)

Conventional dry toners for use in electrophotography, electrostatic recording and electrostatic printing are typically prepared by fusing/kneading toner binders such as styrene-containing resins and polyesters with a colorant and so on followed by finely pulverizing.

(Problems with Reference to Fixability)

These toners are fixed by heating and fusing with a heat roll after the toners are developed and transferred onto a medium such as paper. When the temperature of the heat roll is too high during fixing, the toner is excessively fused and adhered to the heat roll too much, resulting in occurrence of a hot offset problem. When the temperature of the heat roll is too low to sufficiently fuse the toner, there is a problem in that the toner is inadequately fused and thereby fixing is insufficient.

In light of saving energy and miniaturizing devices such as copiers, a toner is desired which has a high hot offset temperature (i.e., high hot offset resistance) and has a low fixing temperature (i.e., good fixability at a low fixing temperature). In addition, the toner is required to be heat-proof so as not to cause blocking when the toner is in storage and is used at an atmospheric temperature in the device in which the toner is installed.

(Problems with Reference to Particle Diameter and Shape)

Toner particle diameters become smaller and smaller in order to improve images by goving high quality and high resolution. However, a toner that is manufactured by an ordinary kneading and pulverization method has an irregular shape. Such a toner is fractured in a machine when the toner is stirred with a carrier or contacts with a developing roller, a toner furnishing roller, a layer regulating blade and a triboelectrical charging blade. Therefore extremely fine particles are generated and the fluidizer on the surface of the toner is buried in the toner, resulting in deterioration of image qualities. In addition, due to its irregular shape, fluidity of the toner is so bad that a large amount of fluidizer has to be included therein, and the toner has a large volume when the toner is filled in a toner container, which is a barrier to miniaturization.

Furthermore, since the process for transferring toner images from a photoreceptor to an intermediate transfer medium or a transfer medium becomes complicated, problems occur such as image omission due to poor transferability stemming from irregularity in the shape of pulverized toners and an increase of toner consumption to compensate the image omission.

Therefore, there is an increasing demand for further improvement in transfer efficiency in order to reduce the amount of toner consumption, obtain high definition images without omission and lower running cost. If transfer efficiency is extremely excellent, it is unnecessary for an image forming apparatus to have a cleaning unit removing untransferred toner from a photoreceptor or a transferring medium. At the same time, there are other merits such as miniaturization of machines, low running cost and no waste toner. In order to avoid the problems arisen from irregularity in shape of the toner, various kinds of spherical toners have been proposed.

Among the toners, the following toners have been proposed particularly for improving high temperature resistance. For example, (1) a toner including a polyester as a toner binder which is partially cross-linked by multifunctional monomers is proposed in published unexamined Japanese Patent Application No. (hereinafter referred to as JOP.) 57-109825 and (2) a toner including a urethane modified polyester as a toner binder is proposed in JOP. 7-101318. In addition, (3) a full color toner prepared by granulating fine polyester particles and fine wax particles is proposed in JOP. 7-56390 in order to reduce the amount of an oil which is applied to a heat roll.

Further, in order to improve powder fluidity and transferability of a toner having a small particle, there have been proposed: (4) a toner polymerized by suspension polymerization after dispersing a vinyl monomer composition including a colorant, a polar resin and a releasing agent in water (JOP. 9-43909); and (5) a spherical toner obtained by granulating a toner, which includes a polyester resin and is dispersed in a solvent, in water (JOP. 9-34167).

In addition, there is disclosed (6) a substantially spherical dry toner made of a polyester resin which is modified by urea bonding in JOP. 11-133666.

However, the toners disclosed in (1) to (3) have such insufficient fluidity and transferability that it is very difficult to obtain quality images even when the toners have a small particle. Further, the toners disclosed in (1) and (2) are not suitable for practical use because of not having a good combination of high temperature preservability and low temperature fixability and because of producing images having unsatisfactory gloss when used as a full color toner. In addition, the toner disclosed in (3) is insufficient in low temperature fixability and further is not satisfactory in the light of hot offset resistance for oil-free fixing. The toners disclosed in (4) and (5) have improved fluidity and transferability. However, the toner disclosed in (4) requires large fixing energy due to its insufficient low temperature fixability. This problem is apparent especially when the toner is used as a full-color toner. The toner disclosed in (5) is superior in low temperature fixability but insufficient in hot offset resistance so that it is inevitable to apply oil to a heat roll when the toner is used as a full-color toner.

The toner disclosed in (6) can produce images having high gloss while having good releasability when used as a full-color toner because viscoelasticity of the toner can be adjusted by using a polyester elongated by urea bonding. Especially the toner disclosed in (6) is effective in preventing images so-called electrostatic offset in that toner images scatters or adheres to a fixing roller when the fixing roller is statically charged. The toner disclosed in (6) can reduce a chance of such toner scattering or adhesion due to electrical neutralization between positive chargeability created by the urea bonding portions of the polyester resin and weak negative-chargeability of the polyester resin per se.

Although the toner has the advantages mentioned above, the toner is fractured in an image forming apparatus when the toner is stirred with a carrier or contacts with a developing roller, a toner furnishing roller, a toner layer regulating blade and a triboelectrically charging blade. Thereby, extremely fine particles tend to be generated and a fluidizer on the surface of the toner is buried in the toner. This results in deterioration of image qualities and a shortening of toner life.

Because of these reasons, a need exists for a dry toner having a small particle diameter, a high electric resistance, a long life and having excellent powder fluidity, transferability and high temperature resistance.

SUMMARY OF THE INVENTION

Accordingly, one object of the present invention is to provide a dry toner having a small particle diameter, a high electric resistance, a long life and excellent powder fluidity, transferability, high temperature resistance, low temperature fixability and hot offset resistance.

Another object of the present invention is to provide a developer using the dry toner, a process cartridge, and an image forming method and apparatus which can produce images having good low temperature fixability and hot offset resistance for a long period of time.

Briefly these objects and other objects of the present invention as hereinafter will become more readily apparent can be attained by a dry toner which is prepared by a method including the steps of (A) dissolving or dispersing a toner composition in an organic solvent to prepare a toner composition liquid and (B) dispersing the toner composition liquid in an aqueous liquid including a binder resin containing a modified polyester (i) and a colorant including a carbon black having a pH not greater than 7. The toner has a volume average particle diameter (Dv) is from 3 to 7 μm and a ratio of the volume average particle diameter (Dv) to a number average particle diameter (Dp) is from 1.00 to 1.25.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1A:
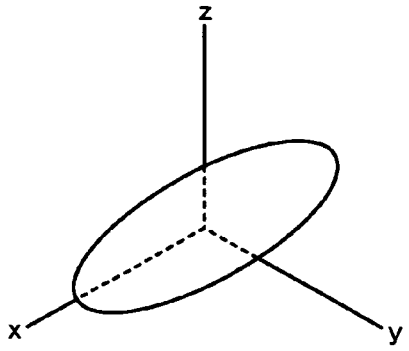
FIGS. 1(A) to 1(C) are diagrams for explaining the major axis particle diameter (r1), the minor axis particle diameter (r2) and the thickness of the toner particle of an embodiment of the toner of the present invention.

The present invention relates to a dry toner which is preferably obtained by dissolving or dispersing a toner material composition in an organic solvent to prepare a toner material liquid and then dispersing the toner material liquid in an aqueous liquid. The dry toner at least contains a modified polyester (i) and carbon black which serves as a colorant and has a pH of not greater than 7, and preferably from 2 to 6. The toner has an average volume particle diameter (Dv) of from 3 to 7 μm and a ratio (Dv/Dp) of the average volume particle diameter (Dv) to the number average particle diameter (Dp) is from 1.00 to 1.25, and preferably from 1.05 to 1.25. This toner has a high electric resistance and is excellent in powder fluidity, transferability, high temperature resistance, low temperature fixability and hot offset resistance.

It is preferable that the toner composition mentioned above include a prepolymer and the modified polyester (i) mentioned above be formed by the prepolymer in the dissolving or dispersing process and the second dispersing process mentioned above.

It is also preferable that the colorant mentioned above be a master batch in which the carbon black is dispersed in a resin.

Further, it is preferable that the resin included in the master batch be a polyester resin.

The toner binder preferably contains the modified polyester (i) and an unmodified polyester (ii), wherein a weight ratio (i)/(ii) is from 5/95 to 80/20.

The unmodified polyester (ii) preferably has an acid value of from 1 to 15 mgKOH/g In addition, the unmodified polyester (ii) preferably has a peak molecular weight of from 1000 to 30000.

Further, the unmodified polyester (ii) preferably has a glass transition temperature (Tg) of from 35 to 55° C.

The dry toner preferably has a spindle shape with a ratio (r2/r1) of the minor axis particle diameter (r2) to the major axis particle diameter (r1) being from 0.5 to 0.8 and a ratio (r3/r2) of the thickness (r3) to the minor axis particle diameter (r2) being from 0.7 to 1.0.

As another aspect of the present invention, a method for manufacturing a toner composition containing toner particles is provided, which includes the steps of dissolving or dispersing a composition at least containing a modified polyester resin (i) capable of reacting with an active hydrogen, a colorant, and a compound having an active hydrogen, in an organic solvent to prepare an oil phase liquid; dispersing the oil phase liquid in an aqueous medium to prepare a dispersion; removing at least the organic solvent in the dispersion to prepare the toner particles; washing the toner particles; and drying the toner particles.

As yet another aspect of the present invention, a developer containing the dry toner is provided.

As yet another aspect of the present invention, a toner container containing the dry toner is provided.

As yet another aspect of the present invention, a process cartridge including a photoreceptor and at least one of a charger configured to charge the photoreceptor, a developing device configured to develop a latent electrostatic image on the photoreceptor with the dry toner and a cleaning device configured to remove a residual toner on the photoreceptor is provided.

As yet another aspect of the present invention, an image forming method is provided, which includes the steps of developing a latent electrostatic image on an image carrier with the developer mentioned above to form a toner image on the image carrier; and transferring the toner image on a transfer medium optionally via an intermediate transfer medium.

As yet another aspect of the present invention, an image forming apparatus is provided which contains an image carrier configured to carry a latent electrostatic image thereon; and a developing device configured to develop the latent electrostatic image with the developer mentioned above to form a toner image on the image carrier.

When a two component developer including the toner is used for a long period of time while the toner is replenished, the variance in the particle diameter of the toner in the developer is small and the developability of the toner is good and stable at repeated stirring over a long period of time in the developing unit. When the toner is used as a single component developer while replenished, the variance in the particle diameter of the toner is small and filming of the toner on a developing roller and fusion bonding of the toner onto a member such as a blade for regulating the thickness of the toner layer hardly occur. Therefore, good and stable developability and images are obtained for an extended use (stirring) of a developing unit.

It is generally said that a toner having a small particle diameter is advantageous to obtain high definition and high quality images, but is disadvantageous in transferability and cleaning properties. When a toner having a volume average particle diameter below the range of the present invention is used in a two component developer, the toner tends to be fusion bonded to the surface of the carrier as stirring repeats for a long period of time and therefore charging ability of the carrier degrades. In the case of a single component developer having too small a volume average particle diameter, filming of the toner on a developing roller and fusion bonding of the toner onto a member such as a blade for regulating the thickness of the toner layer tend to occur.

The same is true for a toner including fine particles at a high content.

On the contrary, when a toner having a large particle diameter above the range of the present invention is used, it is difficult to produce high definition and high quality images. In addition, when the toner is used while replenished, the variance in the toner particle diameter often becomes large. It is also found that this applies to the case of a toner having a ratio of volume average particle diameter to number average particle diameter greater than 1.25.

A toner having a ratio of volume average particle diameter to number average particle diameter less than 1.05, and especially less than 1.00, is preferable because of having good stability and uniform charge quantity. However, the yield of such a toner is extremely poor when the toner is produced, resulting in increase of costs.

It is apparent that the toner prepared from the manufacturing method for use in the present invention, in which a toner material composition is dissolved or dispersed in an organic solvent to prepare a toner material liquid and the toner material liquid is further dispersed in an aqueous liquid, apparently has a small particle diameter with a sharp particle diameter distribution. However, a colorant in the toner, especially carbon black, is insufficiently dispersed compared with a toner prepared by kneading and pulverization. It has been found by the present inventors that a carbon black having a pH not greater than 7, and preferably of from 2 to 6, has a good dispersiblity even after the carbon black is dispersed in an organic solvent. A toner having a high electric resistance with excellent fluidity and transferability is thus obtained.

Dispersibility of a carbon black in a toner can be improved by using a master batch in which the carbon black is dispersed in a resin in advance.

Further, it is found that, when a polyester resin is used as the resin in the master batch, dispersibility of the carbon black in the toner is improved.

A preferred example of the dry toner of the present invention will be described next.

It is preferable that the dry toner according to the present invention have a spindle shape.

When a toner has an irregular or flat shape, the toner easily causes the following problems due to its poor fluidity. The resultant images have background fouling because triboelectric charging is not smoothly performed. In addition, when developing a fine dot of a latent image, the resultant image has poor reproduction because the toner particles do not have a dense and uniform configuration. Further, when toner images are transferred by an electrostatic transfer method, transfer efficiency is inferior because the toner is hardly affected by lines of electric force.

When a toner has a substantially spherical shape, the toner excessively reacts against external forces because of having too good fluidity. This causes a problem in that the toner particles easily scatter around a dot at the time of developing and transferring. Also spherical toners easily roll on a photoreceptor and sneak between the photoreceptor and a cleaning member, which often leads to poor cleaning performance.

Fluidity of the spindle shaped toner of the present invention is so properly adjusted that triboelectric charging is smoothly performed, resulting in formation of images with no background fouling. Therefore minute dots can be orderly developed with the toner and the toner image is efficiently transferred, resulting in superior dot reproduction. In addition, the proper fluidity prevents toner scattering at this time. In general, a spindle shaped toner has a limited number of axes, around which the toner particle revolves, compared with a spherical toner particle. Therefore, a poor cleaning performance caused by toner particles sneaking under a cleaning member rarely occurs.

Figure 1B:
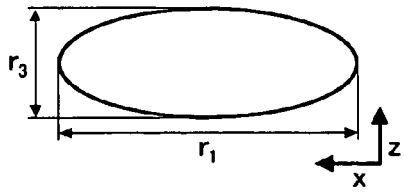
Figure 1C:
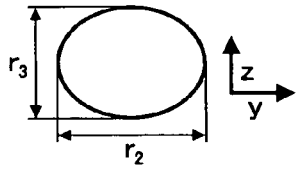

The toner shape will be described with reference to FIGS. 1(*a*) to 1(*c*).

The toner of the present invention preferably has a spindle shape having a ratio (r2/r1) of from 0.5 to 0.8, more preferably from 0.5 to 0.7, wherein r2 is the minor axis particle diameter and r1 is the major axis particle diameter, and a ratio (r3/r2) of from 0.7 to 1.0, more preferably from 0.8 to 1.0, wherein r3 is the thickness thereof and r2 is the minor axis particle diameter. When the ratio (r2/r1) is not greater than 0.5, cleaning performance is good since the toner shape is away from being spherical. However, the toner tends to have poor dot representation and transfer efficiency, resulting in formation of low quality images. In contrast, when the ratio (r2/r1) is greater than 0.8, the toner shape is nearer to a spherical shape, and therefore the toner tends to provide especially bad cleaning performance in a low temperature/humidity environment.

In addition, when the ratio (r3/r2) is not greater than 0.7, the toner shape is near to a flat form so that toner scattering hardly occurs as in the case of a toner having an irregular shape but a high transfer rate cannot be obtained unlike the case of a toner having a spherical shape. Especially when the ratio (r3/r2) of thickness to minor axis particle diameter is 1.0, the toner particle revolves around the major axis thereof. When a toner has a spindle shape with the ratio (r3/r2) of 1.0, the toner shape is not irregular, flat or spherical. Therefore, the toner can have all the advantages of both shapes, i.e., a good combination of triboelectric charging, dot reproduction, transfer efficiency, toner scattering avoidability and cleanability.

The particle dimensions, r1, r2 and r3 of the toner can be determined by taking photos of the toner particles using a scanning electron microscope (SEM) while observing the particles from different angles.

(Modified Polyesters)

The modified polyesters for use as a binder resin of the dry toner of the present invention are polyesters which have functional groups other than the functional groups contained in acid and alcohol monomer units or bonding groups other than the ester bonding group, or polyesters with which a resin component different from those of the polyesters is bonded by covalent bonding or ionic bonding.

Specific examples thereof include polyester resins having an end which is formed by a bonding other than ester bonding. Such polyester resins can be prepared, for example, by incorporating a functional group such as isocyanate groups, which can react with acid groups and hydroxyl groups, at the end of a polyester and reacting the functional group with an active hydrogen compound to perform a modification or elongation reaction.

Further, by using a compound having a plurality of active hydrogen atoms, ends of polyesters can be bonded with each other. The thus prepared urea modified polyesters, urethane modified polyesters and so on, can also be readily used as the modified polyesters.

Modified polyesters can also be prepared by introducing a reactive group such as double bond within the main chain of a polyester resin and performing a radical polymerization reaction thereon to graft a component having C—C bonding or bridging double bonds. Styrene modified polyesters and acrylic modified polyesters are examples of these types of modified polyesters that can also be used as the modified polyester.

Also polyester resins which have a different resin unit within the main chain thereof through copolymerization or polyester resins which are prepared by reacting an end of a polyester with a carboxyl group or a hydroxyl group can be used as the modified polyester.

Specific examples thereof include a modified polyester which is copolymerized with a silicone resin having ends which are modified by a carboxyl group, a hydroxyl group, an epoxy group or a mercapto group (e.g., silicone modified polyesters).

Specific preferred examples will be described as follows.

(A Synthetic Example of Polystyrene Modified Polyesters)

A polystyrene graft modified polyester (i) can be obtained, for example, as follows.

(1) The following components are placed in a reacting container having a condenser, a stirrer and a nitrogen introducing tube and reacted for 8 hours at 230° C. under normal pressure.

| | |
|---|---|
| Adduct of bisphenol A with 2 moles of ethylene oxide | 724 |

-continued

| | |
|---|---|
| Isophthalic acid | 200 |
| Fumaric acid | 70 |
| Dibutyl tin oxide | 2 |

(2) The reaction is further performed for 5 hours under a reduced pressure of from 10 to 15 mmHg.

(3) Subsequent to cooling down to 160° C., 32 parts of phthalic anhydride are added thereto and the resulting mixture allowed to react for 2 hours.

(4) Subsequent to cooling down to 80° C., 200 parts of styrene, 1 part of benzoyl peroxide and 0.5 parts of dimethyl aniline are mixed with the reaction product in ethyl acetate and the resulting mixture allowed to react for 2 hours.

(5) Ethyl acetate is removed from the reaction product by distillation.

Thus a polystyrene graft modified polyester (i) having an average molecular weight of 92000 is prepared.

(Urea Modified Polyester)

Specific examples of a urea modified polyester (i) include a reactant of a polyester prepolymer (A) having an isocyanate group with amine (B). Specific examples of the polyester prepolymer (A) having an isocyanate group include polyesters prepared by reacting an active hydrogen group of a polycondensation compound of a polyol (1) and a polycarboxylic acid (2) with a polyisocyanate (3). Specific examples of the active hydrogen group contained in the polyesters mentioned above include hydroxyl groups (alcohol hydroxyl groups and phenol hydroxyl groups), amino groups, carboxylic groups and mercarpto groups. Among these, alcohol hydroxyl groups are preferable.

Specific examples of the polyol (1) are diols (1-1) and polyols (1-2) having at least 3 hydroxyl groups. A diol (1-1) alone or in combination with a small quantity of one or more polyols (1-2) are preferable as the polyol (1). Specific preferred examples of the diols (1-1) are alkylene glycols (e.g., ethylene glycol, 1,2-propylene glycol, 1,3-propylene glycol, 1,4-butane diol and 1,6-hexan diol), alkylene ether glycol (e.g., diethylene glycol, triethylene glycol, dipropylene glycol, polyethylene glycol, polypropylene glycol, and polytetra methylene ether glycol), alicyclic diols (e.g., 1,4-cyclo hexane dimethanol, hydrogen added bisphenol A, and bisphenol groups (bisphenol A, bisphenol F and bisphenol S), adducts of the alicyclic diols mentioned above with alkylene oxides (e.g., ethylene oxides, propylene oxides, butylene oxides), and the bisphenols mentioned above with alkylene oxides (e.g., ethylene oxides, propylene oxides and butylene oxides). Among these, alkylene glycols having 2 to 12 carbon atoms and adducts of bisphenol groups with alkylene oxides are preferable, and adducts of bisphenol groups with alkylene oxides and combinations of adducts of one or more bisphenols with one or more alkylene oxides and alkylene glycols having 2 to 12 carbon atoms are especially preferable. Specific examples of the polyols (1-2) having at least 3 hydroxyl groups include aliphatic alcohols having 3 or more hydroxyl groups (e.g., glycerine, trimethylol ethane, trimethylol propane, pentaerythritol and sorbitol), polyphenols having at least 3 hydroxyl groups (e.g., trisphenol PA, phenol novolak and cresol novolak) and adducts of polyphenols having at least 3 hydroxyl groups with the alkylene oxides mentioned above.

Specific examples of the polycarboxylic acid (2) are dicarboxylic acids (2-1) and polycarboxylic acids (2-2)

having at least 3 hydroxyl groups, with a dicarboxylic acid (2-1) alone or in combination with a small quantity of one or more polycarboxylic acids (2-2) being preferable as the polycarboxylic acid (2). Specific preferred examples of dicarboxylic acid (2-1) include alkylene dicarboxylic acid (e.g., succinic acid, adipic acid and sebacic acid), alkenylene dicarboxylic acid (e.g., maleic acid and fumaric acid), and aromatic dicarboxylic acids (e.g., phthalic acid, isophthalic acid, terephthalic acid and naphthalene dicarboxylic acid). Among the diacids, the alkenylene dicarboxylic acids having 4 to 20 carbon atoms and the aromatic dicarboxylic acids having 8 to 20 carbon atoms are preferable. Specific preferred examples of polycarboxylic acids (2-2) having at least 3 carboxyl groups include aromatic polycarboxylic acid having 9 to 12 carbon atoms (e.g., trimellitic acid and pyromellitic acid). In addition, the polycarboxylic acids (2) can be obtained by reacting acid anhydrides or lower alkyl esters (e.g., methyl esters, ethyl esters and isopropyl esters) of the above-mentioned with the polyols (1).

The mixing ratio of the polyol (1) to the polydicarboxylic acid (2), i.e., the equivalent ratio ([OH]/[COOH]) of a hydroxyl group [OH] to a carboxyl group [COOH], is normally from 2/1 to 1/1, preferably from 1.5/1 to 1/1, and more preferably from 1.3/1 to 1.02/1.

Specific preferred examples of the polyisocyanate (3) include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexyl methane diisocyanate); aromatic diisocyanates (e.g., tolylene diisocyanate and diphenylmethane diisocyanate); aromatic aliphatic diisocyanates (e.g., α, α, α', α'-tetramethyl xylylene diisocyanate); isocyanurates; and blocked polyisocyanates in which the polyisocyanates mentioned above are blocked with phenol derivatives, oximes or caprolactams. These compounds can be used alone or in combination.

The mixing ratio of the polyisocyanate (3) to the polyester, i.e., the equivalent ratio ([NCO]/[OH]) of an isocyanate group [NCO] to a hydroxyl group [OH] of a polyester having hydroxyl groups, is normally from 5/1 to 1/1, preferably from 4/1 to 1.2/1, and more preferably from 2.5/1 to 1.5/1. When the [NCO]/[OH] ratio is greater than 5, the low temperature fixability of the toner tends to deteriorate. When the equivalent ratio of [NCO]/[OH] is less than 1, the urea content in the resultant modified polyesters decreases and thereby the hot-offset resistance of the toner tends to deteriorate.

The content of the constitutional component, which is obtained from the polyisocyanate (3), in the prepolymer (A) having an isocyanate group at its end portion is from 0.5 to 40% by weight, preferably from 1 to 30% by weight and more preferably from 2 to 20% by weight. When the content is less than 0.5% by weight, the hot offset resistance of the toner tends to deteriorate and in addition it is hard for the toner to have good heat resistance and low temperature fixability. In contrast, when the content is greater than 40% by weight, the low temperature fixability of the toner tends to deteriorate.

The number of isocyanate groups included in the prepolymer (A) per molecule is normally not less than 1, preferably from 1.5 to 3, and more preferably from 1.8 to 2.5. When the number of isocyanate groups is less than 1 per molecule, the molecular weight of the modified polyester tends to decrease and thereby the hot offset resistance tends to deteriorate.

Specific preferred examples of the amine (B) include diamines (B1), polyamines (B2) having three or more amino groups, amino alcohols (B3), amino mercaptans (B4), amino acids (B5) and blocked amines (B6) in which the amines (B1–B5) mentioned above are blocked. Specific preferred examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc. Specific examples of the polyamines (B2) having three or more amino groups include diethylene triamine, triethylene tetramine.

Specific preferred examples of the amino alcohols (B3) include ethanol amine and hydroxyethyl aniline. Specific examples of the amino mercaptan (B4) include aminoethyl mercaptan and aminopropyl mercaptan. Specific preferred examples of the amino acids (B5) include amino propionic acid and amino caproic acid. Specific examples of the blocked amines (B6) of B1 to B5 include ketimine compounds which are prepared by reacting one of the amines B1–B5 mentioned above with a ketone such as acetone, methyl ethyl ketone and methyl isobutyl ketone; oxazoline compounds, etc. Among these amines (B) B1 and a mixture of B1 and a small quantity of B2 are preferable.

The molecular weight of the modified polyesters can be controlled using a molecular-weight control agent, if desired.

Specific preferred examples of the molecular-weight control agent include monoamines (e.g., diethyle amine, dibutyl amine, butyl amine and lauryl amine), and blocked amines (i.e., ketimine compounds) prepared by blocking the monoamines mentioned above.

The mixing ratio of the amines (B) to the prepolymer (A), i.e., the equivalent ratio ([NCO]/[NHx]) of the isocyanate group [NCO] contained in the prepolymer (A) to the amino group [NHx] contained in the amines (B), is normally from 1/2 to 2/1, preferably from 1.5/1 to 1/1.5 and more preferably from 1.2/1 to 1/1.2. When the mixing ratio is greater than 2 or less than 1/2, the molecular weight of the resultant urea-modified polyester (i) decreases, resulting in deterioration of the hot offset resistance of the resultant toner.

In the present invention, the modified polyester (i) can include a urethane linkage as well as a urea linkage. The molar ratio (urea/urethane) of the urea linkage to the urethane linkage is from 100/0 to 10/90, preferably from 80/20 to 20/80 and more preferably from 60/40 to 30/70. When the content of the urea bonding is less than 10%, the hot offset resistance of the resultant toner deteriorates.

The modified polyester (i) can be prepared, for example, by a method such as one-shot methods or prepolymer methods. The weight average molecular weight of the modified polyester (i) is not less than 10,000, preferably from 20,000 to 10,000,000 and more preferably from 30,000 to 1,000,000. When the weight average molecular weight is less than 10,000, the hot offset resistance of the resultant toner deteriorates. When an unmodified polyester (ii) described later is used in combination with the modified polyester (i), the number average molecular weight of the modified polyester (i) is not particularly limited if the weight average molecular weight mentioned above is allowed. When the modified polyester (i) is used alone, the number average molecular weight is normally not less than 20000, preferably from 1000 to 10000 and more preferably from 2000 to 8000. When the number average molecular weight is greater than 20000, low temperature fixability of the resultant toner deteriorates and, in addition, the gloss properties thereof also deteriorate when the toner is used in a full color device.

(Unmodified Polyester)

In the present invention, not only can the modified polyester (i) mentioned above be used alone as a toner binder constituent, but also the unmodified polyester (ii) can be contained as a binder resin in combination with the modified polyester (i). The combined use of (i) and (ii) can improve low temperature fixability and therefore is preferable to the single use of (i) alone. Specific preferred examples of the unmodified polyester (ii) include polycondensation products of polyol (1) and polycarboxylic acid (2) as mentioned above for use in the polyester constituents of the modified polyester (i) mentioned above. It is preferable that (i) and (ii) be at least partially mixed with each other in light of the desired low temperature fixability and hot offset resistance properties. Therefore, it is preferable, but not mandatory, that the unmodified polyester (ii) have a similar composition to that of the polyesters of (i), with respect to the polyol (i) and polycarboxylic acid (ii) constituents.

The weight ratio of (i)/(ii) is normally from 5/95 to 80/20, preferably from 5/95 to 30/70, more preferably from 5/95 to 25/75 and even more preferably from 7/93 to 20/80. When the content of the modified polyester (i) is less than 5% by weight, the hot offset resistance of the toner tends to deteriorate and in addition it is hard for the toner to have both the high temperature preservability and low temperature fixability desired.

The peak weight average molecular weight of the unmodified polyester (ii) is normally from 1000 to 30000, preferably from 1500 to 10000 and more preferably from 2000 to 8000. When the peak molecular weight is less than 1000, the high temperature preservability deteriorates. When the peak molecular weight is greater than 10000, the low temperature fixability deteriorates. The hydroxyl group value of the unmodified polyester (ii) is preferably not less than 5 mgKOH/g, more preferably from 10 to 120 mgKOH/g and even more preferably 20 to 80 mgKOH/g. When the hydroxyl group value of the unmodified polyester (ii) is less than 5 mgKOH/g, it is hard for the toner to have both the high temperature preservability and low temperature fixability. The acid value of the unmodified polyester (ii) is normally from 1 to 30 mgKOH/g, preferably from 5 to 20 mgKOH/g and more preferably from 1 to 15 mgKOH/g. By adding the unmodified polyester (ii) having such an acid value, the resultant toner tends to be negatively charged.

The modified polyester (i) of the present invention preferably has a glass transition temperature (Tg) of from 50 to 70° C., and more preferably from 55 to 65° C. When the glass transition temperature is lower than 50° C., the high temperature preservability of the toner deteriorates. When the glass transition temperature is higher than 70° C., the low temperature fixability becomes insufficient. In addition, the glass transition temperature of the unmodified polyester (ii) is preferably from 35 to 55° C. When the unmodified polyester (ii) has a glass transition temperature lower than 35° C., the toner may be blocked when the toner is stored in a high temperature environment. When the toner is stored at a temperature higher than 55° C., fixability becomes insufficient and the minimum fixable fixing temperature may increase.

Since an unmodified polyester resin coexists with a modified polyester resin, the dry toner of the present invention can have a good high temperature preservability even when the toner has a relatively low glass transition temperature compared with known toners formed of polyesters.

The toner of the present invention preferably has a storage modulus of elasticity of 10,000 dyne/cm$^2$ at a temperature (TG') not lower than 100° C., and more preferably from 110 to 200° C. when measured at a frequency of 20 Hz. When the temperature TG' is lower than 100° C., the toner has poor hot offset resistance. In addition, the toner of the present invention preferably has a viscosity of 1000 poise at a temperature (Tη) not higher than 180° C., and more preferably from 90 to 160° C. When the temperature Tη is higher than 180° C., the low temperature fixability of the toner deteriorates. Namely, in view of compatibility between low temperature fixability and hot offset resistance, the temperature TG' of the toner is preferably higher than the temperature Tη, i.e., the difference between TG' and Tη (TG'−Tη) is preferably not less than 0° C. More preferably, the difference is not less than 10° C. and even more preferably not less than 20° C. There is no upper limit to the difference. However, in view of compatibility between high temperature preservability and low temperature fixability, the difference (TG'−Tη) is preferably from 0 to 100° C., more preferably from 10 to 90° C., and even more preferably from 20 to 80° C.

(Releasing Agent)

The toner of the present invention can include othe components, indicating but not limited to, a wax as well as a toner binder and a colorant. Known waxes for use in conventional toners can be used in the toner of the present invention. The wax can be used singly or in a combination of two or more waxes as desired.

Suitable releasing agents include, but are not limited to polyolefin waxes (e.g., polyethylene waxes and polypropylene waxes); hydrocarbons having a long chain (e.g., paraffin waxes and SASOL waxes); and waxes having a carbonyl group. Among these materials, waxes having a carbonyl group are preferably used for the toner of the present invention.

Specific preferred examples of the waxes including a carbonyl group include polyalkanoic acid esters such as carnauba waxes, montan waxes, trimethylolpropane tribehenate, pentaerythritol tetrabehenate, pentaerythritol diacetate dibehenate, glycerin tribehenate, and 1,18-octadecanediol distearate; polyalkanol esters such as tristearyl trimellitate, and distearyl maleate; polyalkanoic acid amides such as ethylenediamine dibehenylamide; polyalkylamides such as trimellitic acid tristearylamide; dialkyl ketone such as distearyl ketones; etc. Among these materials, polyalkanoic acid esters are more prefeered. The waxes for use in the present invention normally have a melting point of from 40 to 160° C., preferably from 50 to 120° C. and more preferably from 60 to 90° C. Waxes having a melting point lower than 40° C. adversely affect high temperature preservability and waxes having a melting point higher than 160° C. tend to cause cold offset when fixed at a low temperature. In addition, the wax preferably has a melting viscosity of from 5 to 1000 cps, and more preferably from 10 to 100 cps, at a temperature 20° C. higher than the melting point thereof. Waxes having a melting viscosity higher than 1000 cps deteriorates hot offset resistance and low temperature fixability.

The content of a wax contained in the toner is normally from 0 to 40% by weight and preferably from 3 to 30% by weight.

(Charge Controlling Agent)

The toner of the present invention optionally includes a charge controlling agent. Known charge controlling agents can be used for the toner of the present invention either singly or as a combination of 2 or more. Specific preferred examples of the charge controlling agents include nigrosine dyes, triphenyl methane dyes, metal compounds dyes including chrome, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, metal salts of salicylic acid derivatives, etc.

Specific more preferred examples of the charge controlling agents include BONTRON 03 (nigrosine dyes), BONTRON P-51 (quaternary ammonium salt), BONTRON E-82 (metal complex of oxynaphthoic acid), BONTRON S-34 (azo dyes containing a metal), BONTRON E-84 (metal complex of salicylic acid), and BONTRON E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE PR (triphenyl methane derivative), COPY CHARGE NEG VP2036 and COPY CHARGE NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments, and polymers having a functional group such as a sulfonate group, a carboxyl group, a quaternary ammonium group, etc.

The content of charge controlling agents in the toner of the present invention depends on the kind of the toner binder resin used, whether other additives are used, and the toner manufacturing method used (including the dispersing method) and therefore there is no specific limitation thereto. However, it is preferable that the charge controlling agent be used in an amount of from 0.1 to 10 parts by weight per 100 parts by weight of the binder resin and more preferably of from 0.2 to 5 parts by weight. When the amount is greater than 10 parts by weight, the toner is so excessively charged that electrostatic attraction force between the toner and a developing roller increases, resulting in deterioration of fluidity of the developer and deterioration of image density.

These charge controlling agents and releasing agents can be fused and kneaded with a master batch and a resin and can be added when dissolved and dispersed in an organic solvent.

(External Additive)

In order to improve fluidity, developability and chargeability of the toner coloring particles (mother toner particles), inorganic particulates can be preferably added thereto. Such inorganic particulates preferably have a primary particle diameter of from 5 nm to 2 μm and more preferably of from 5 nm to 500 nm. In addition, it is preferable that a specific surface area thereof be from 20 to 500 $m^2/g$ when measured by a BET method. The content of the inorganic particulates in the toner is preferably from 0.01% to 5.0% by weight, and more preferably from 0.01% to 2.0% by weight, based on the total weight of the toner.

Specific preferred examples of such inorganic particulates include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

Other than the above, particulate polymers, (which can be prepared by a method such as soap free emulsion polymerization, suspension polymerization or dispersion polymerization), such as copolymers of polystyrene, methacrylic acid esters and acrylic acid esters, particulate polycondensation compounds (e.g., silicone resins, benzoguanamine resins and nylons), and polymers of thermosetting resins can also be used.

When such external additives (fluidizers) are surface treated to improve hydrophobicity, good fluidity and chargeability can be maintained even in a high humidity environment. Suitable surfactants for use in the hydrophobizing treatment include silane coupling agents, silylation agents, silane coupling agents having a fluorinated alkyl group, organic titanate coupling agents, aluminum coupling agents, silicone oils, modified silicone oils, etc.

The toner can optionally include a cleanability improving agent to easily remove toner particles which remain on an image carrier such as a photoreceptor and a first transfer medium after a toner image is transferred.

Specific preferred examples of such cleanability improving agents include fatty acids and their metal salts such as stearic acid, zinc stearate, and calcium stearate; and particulate polymers such as polymethyl methacrylate and polystyrene, which can be manufactured by a method such as soap-free emulsion polymerization methods. Such particulate polymers preferably have a relatively sharp particle diameter distribution and a volume average particle diameter of from 0.01 to 1 μm.

(Manufacturing Method)

An example of a method for manufacturing the dry toner of the present invention will be described. The toner binders can be manufactured, for example, by the following method:

(1) Heat polyol (1) and polycarbonic acid (2) to 150 to 280° C. in the presence of a known esterification catalyst such as tetra butoxy titanate and dibutyl tin oxide.
(2) Remove the generated water while decreasing the pressure if necessary to obtain a polyester having a hydroxyl group.
(3) React the polyester with polyisocyanate (3) at temperatures in the range of from 40 to 140° C. to obtain a prepolymer (A) having an isocyanate group.
(4) React the prepolymer (A) with amine (B) at temperatures in the range of from 0 to 140° C. to obtain modified polyester (i).

A solvent or mixture of solvents can be optionally used for the reaction of the polyester with polyisocyanate (3) and the reaction of the polymer (A) with the amine (B).

Suitable solvents include, but are not limited to, aromatic solvents such as toluene and xylene; ketones such as acetone, methyl ethyl ketone and methyl isobutyl ketone; esters such as acetic ether; amides such as dimethyl formamide and dimethyl acetamide; and ethers such as tetrahydrofuran which are inactive to isocyanate (3).

When the unmodified polyester (ii) is contained, the unmodified polyester (ii) is prepared in the method similar to that for the polyester having a hydroxyl group. The unmodified polyester (ii) is dissolved in the resultant solution of (i) mentioned above to be mixed.

The dry toner can be manufactured by the following method, but the manufacturing method is not limited thereto.

(Fusing, Kneading and Pulverizing Method)

(1) Toner constituents such as a binder resin including the modified polyester resin (i), a charge controlling agent and a pigment are mechanically mixed. A typical mixer having a revolving blade can be used under conventional conditions. There is no restriction in this mixing process.
(2) After the mixing process, the mixture is set in a kneading machine for fusing and kneading. As fusing and kneading machine, continuous kneading machines such as one-shaft kneading machines and two-shaft kneading machines, and batch type kneading machines such as roll mills can be used.

It is important that fusing and kneading be performed in such a way that the molecular chains of the binder resin are not sheared. Specifically, the temperature for fusing and kneading is preferably determined while taking into consideration the softening point of the toner binder resin. When the fusing and kneading temperature is too low relative to the softening point, excessive shearing occurs. In contrast when the fusing and kneading temperature is too high, dispersion does not proceed.

(3) After the fusing and kneading process mentioned above, pulverize the kneaded toner constituents. In this pulverization process, it is preferable to roughly pulverize the kneaded toner constituents followed by fine pulverizing. In this process, the kneaded toner constituent is preferably pulverized by hitting the kneaded toner constituents against a collision board in a jet air stream or by passing through a narrow gap between a rotor which mechanically revolves and a stator.

(4) After the pulverization process, the pulverized toner constituents are classified in an air stream using a centrifugal force, etc. to prepare toner particles (i.e., mother particles) having a predetermined particle diameter, for example, such as an average particle diameter of from 5 to 20 μm.

In addition, when preparing a toner, an inorganic particulate (i.e., an external additive) such as the hydrophobic silica particulate mentioned above can be optionally added to the thus manufactured toner particles to improve fluidity, preservability, developability and transferability of the toner.

In the process of mixing the external additive, a conventional powder mixer is used. It is preferable that the powder mixer be equipped with a jacket and the like to adjust the internal temperatures thereof. In order to change stresses on the external additive, the external additive may be added in separate times or step by step.

It is also possible to change stress by varying the number of rotation, tumbling speed, and mixing time and temperature. For example, a method in which a strong stress is first applied and then a relatively weak stress is applied, or vice versa can be used.

Specific preferred examples of mixing facilities include v-type mixers, rocking mixers, Loedige Mixers, NAUTA mixers and HENSCHEL MIXERS.

There are various methods useful for rounding the obtained toner particles as follows: a mechanical pulverization method including the steps of: (1) fusing/kneading the toner constituents including a toner binder and a colorant, (2) finely pulverizing the kneaded toner constituents and (3) mechanically rounding the finely pulverized toner constituents using a hybridizer and MECHANOFUSION; a spray drying method including the steps of: (1) dissolving and dispersing toner constituents including at least a binder resin and a colorant in a solvent which can dissolve the toner binder; and (2) removing the solvent using a spray drying device; and a method including the steps of: heating toner constituents in an aqueous medium. However the rounding methods are not limited thereto and any desired method can be used.

(Toner Manufacturing Method in Aqueous Medium)

Suitable aqueous media for use in the method of manufacturing the toner of the present invention include water and mixtures of water and a solvent which can be mixed with water. Specific preferred examples of such a solvent include alcohols (e.g., methanol, isopropanol and ethylene glycol), dimethylformamide, tetrahydrofuran, cellosolves (e.g., methyl cellosolve) lower ketones (e.g., acetone and methyl ethyl ketone), etc.

Toner particles can be prepared by reacting a dispersion element including the prepolymer (A) having an isocyanate group with an amine (B) in an aqueous medium or by dispersing the modified polyester (i) which is prepared in advance in an aqueous medium. In order to stably disperse the polyester (i) or the prepolymer (A) in an aqueous medium, a method in which toner constituents including the modified polyester (i) or the prepolymer (A) are added in an aqueous medium and dispersed by a shearing force is preferably used. Although the prepolymer (A) and other toner components (hereinafter referred to as toner materials) such as a colorant, a colorant master batch, a releasing agent, a charge controlling agent and an unmodified polyester resin (ii) can be mixed in an aqueous medium when forming a dispersion element, it is preferable that the toner materials be mixed first and then the mixture added and dispersed in an aqueous medium. In the present invention, the other toner materials such as a colorant, a releasing agent and a charge controlling agent are not necessarily mixed at the time of forming particles in an aqueous medium but can be added after particles are formed. For example, a colorant can be added by a method in which particles including no colorant are dyed by a known dyeing method.

There is no particular restriction for the dispersion method. Low speed shearing methods, high speed shearing methods, friction methods, high pressure jet methods, ultrasonic methods, etc. can preferably be used. Among these methods, high speed shearing methods are more preferable because particles having a particle diameter of from 2 μm to 20 μm can be easily prepared.

When a high speed shearing type dispersion machine is used, there is no particular limit to the rotation speed thereof, but the rotation speed is typically from 1000 to 30000 rpm, and preferably from 5000 to 20000 rpm. The dispersion time is also not particularly limited, but is typically from 0.1 to 5 minutes for a batch production method. The temperature in the dispersion process is typically from 0 to 150° C. (under pressure), and preferably from 40 to 98° C. The dispersion process is preferably performed at a high temperature because a dispersion element including the modified polyester (i) or the prepolymer (A) has a low viscosity at a high temperature.

The amount of the aqueous medium is normally from 50 to 2000 parts by weight and preferably from 100 to 1000 parts by weight per 100 parts by weight of toner material including the modified polyester (i) or the prepolymer (A). When the amount of the aqueous medium is too small, the toner materials do not disperse well and thereby toner particles having a predetermined particle diameter cannot be obtained. When the amount is too large, the manufacturing cost increases. Dispersants can be used if necessary. It is preferable to use a dispersant because the toner can have a sharp particle diameter distribution and can be dispersed well.

Specific preferred examples of the dispersants which are used for emulsifying and dispersing an oil phase liquid, in which toner constituents are dispersed, in an aqueous phase liquid, include anionic surfactants such as alkylbenzene sulfonic acid salts, α-olefin sulfonic acid salts, and phosphoric acid esters; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi (aminoethyl)glycin, di(octylaminoethyle)glycin, and N-alkyl-N,N-dimethylammonium betaine.

A surfactant having a fluoroalkyl group is particularly effective even in an extremely small amount. Specific preferred examples of anionic surfactants having a fluoroalkyl group include fluoroalkyl carboxylic acids having 2 to 10 carbon atoms and their metal salts, disodium perfluoro octanesulfonyl glutamate, sodium 3-{omega-fluoroalkyl (C6–C11)oxy}-1-alkyl(C3–C4) sulfonate, sodium 3-{omega-fluoroalkanoyl(C6–C8)-N-ethylamino}-1-propan esulfonate, fluoroalkyl(C11–C20) carboxylic acids and their metal salts, perfluoroalkylcarboxylic (C7–C13) acids and their metal salts, perfluoroalkyl(C4–C12)sulfonate and their metal salts, perfluorooctanesulfonic acid diethanol amides, N-propyl-N-(2-hydroxyethyl)perfluorooctanesulfone amide, perfluoroalkyl(C6–C10)sulfoneamidepropyltrimethylammo nium salts, salts of perfluoroalkyl(C6–C10)-N-ethylsulfonyl glycine, monoperfluoroalkyl(C6–C16)ethylphosphate esters, etc.

Specific more preferred examples of the marketed products of such surfactants include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833, which are manufactured by Dainippon Ink and Chemicals, Inc.; ECTOP EF-102, 103, 104, 105, 112, 123A, 123B, 306A, 501, 201 and 204, which are manufactured by Tohchem Products Co., Ltd.; and FUTARGENT F-100 and F150, which are manufactured by Neos.

Specific preferred examples of the cationic surfactants include primary, secondary and tertiary aliphatic amines having a fluoroalkyl group, aliphatic quaternary ammonium salts such as perfluoroalkyl(C6–C10)sulfoneamidepropyltrimethylammo nium salts, benzalkonium salts, benzetonium chloride, pyridinium salts, imidazolinium salts. Specific more preferred examples of the marketed products thereof include SURFLON S-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

In addition, inorganic dispersants, which are hardly soluble in water, such as tricalcium phosphate, calcium carbonate, titanium oxide, colloidal silica, and hydroxyapatite can also be used.

Further, it is possible to stabilize dispersion droplets using a polymeric protection colloid. Specific preferred examples of such protection colloids include homopolymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycol monomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers and copolymers having a nitrogen atom or an heterocyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

In order to remove an organic solvent from the thus prepared emulsified dispersion, a method in which the emulsion is gradually heated to substantially completely evaporate the organic solvent included in the drops of the oil phase liquid can be used. Alternatively, a method in which the emulsion is sprayed in a dry environment to remove the nonaqueous solvent in the droplets, resulting in formation of toner particles, and thereafter water in the dispersion is evaporated, can be used. Specific preferred examples of such a dry environment include gases of air, nitrogen, carbon dioxide, combustion gas, etc. It is preferable that those gases be heated to a temperature not lower than the boiling point of the solvent having the highest boiling point among the solvents used in the emulsion. Toner particles having desired properties can be rapidly prepared by performing this treatment using a spray dryer, a belt dryer, a rotary kiln, or the like.

When compounds such as calcium phosphate which are soluble in an acid or alkali are used as a dispersion stabilizer, the resultant toner particles are preferably mixed with an acid such as hydrochloric acid to dissolve calcium phosphate, followed by washing with water to remove calcium phosphate from the toner particles. In addition, calcium phosphate can be removed using a zymolytic method.

When a dispersant is used, the resultant particles are preferably washed after the particles are subjected to an elongation and/or a crosslinking reaction to impart good chargeability to the particles.

Further, in order to reduce the viscosity of the dispersion of the toner materials, a solvent which dissolves the modified polyester (i) or the prepolymer (A) can be added. It is preferable to use such a solvent to allow the resultant toner to have a sharp particle diameter distribution. Volatile solvents having a boiling point lower than 100° C. are preferably used as the solvent because such solvents can be removed with ease after the particles are formed.

Specific preferred examples of such a solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination. Among these solvents, aromatic solvents such as toluene and xylene; and halogenated hydrocarbons such as methylene chloride, 1,2-dichloroethane, chloroform, and carbon tetrachloride are more preferably used.

The addition amount of such a solvent is not limited, but is generally from 0 to 300 parts by weight, preferably from 0 to 100 parts by weight and more preferably from 25 to 70 parts by weight, per 100 parts by weight of the prepolymer (A) used. When such a solvent is used to prepare a particle dispersion, the solvent is removed upon application of heat thereto under a normal or reduced pressure after the particles are subjected to an extension treatment and/or a crosslinking treatment.

The reaction time of extension and/or crosslinking is determined depending on the reacting property of the isocyanate structure of the prepolymer (A) with the amine (B) used, but the reaction time is generally from 10 minutes to 40 hours, and preferably 2 hours to 24 hours. The reaction temperature is generally from 0 to 150° C. and preferably from 40 to 98° C. In addition, known catalysts can optionally be used. Specific preferred examples of the catalysts include dibutyltin laurate and dioctyltin laurate.

When the resultant toner has a wide particle diameter distribution at the time of emulsification dispersion and the wide particle diameter distribution is maintained during a washing and drying treatment, it is possible to prepare a toner having a desired particle diameter distribution by classifying the produced toner.

Fine particles can be removed from the toner by classification using a cyclone, a decanter or a device using a centrifugal force while the toner is in a liquid. It is also possible to classify a toner which is obtained by drying the dispersion. However classification in a liquid is preferable in the light of efficiency. The thus obtained unwanted fine particles and coarse particles can be returned to the kneading process to form particles again even when those fine particles and coarse particles are wet.

It is preferable to remove the used dispersant from the obtained dispersion liquid as much as possible at the same time of the classification mentioned above.

The thus obtained toner powder can be mixed with fine particles of other materials such as a releasing agent, a charge controlling agent, a fluidizer agent and a colorant. These materials can be fixed and fused on the surface of the toner powder by, for example, a mechanical impact on the powder mixture in order to prevent the particles from detaching from the toner particles.

Specific preferred examples of the method include: a method of making an impact on a mixture with a blade rotating at a high speed and another method of colliding particles against each other or complex particles against a collision board.

Specific more preferred examples of such mechanical impact applicators include ONG MILL (manufactured by Hosokawa Micron Co., Ltd.), modified I TYPE MILL in which the air pressure for pulverizing is reduced (manufactured by Nippon Pneumatic Mfg. Co., Ltd.), HYBRIDIZATION SYSTEM (manufactured by Nara Machine Co., Ltd.), KRYPTRON SYSTEM (manufactured by Kawasaki Heavy Industries, Ltd.), and automatic mortars.

(Carrier for a Two Component Developer)

The toner of the present invention can be used for a two component developer in which the toner is mixed with a magnetic carrier. The weight ratio (T/C) of the toner (T) to the carrier (C) is preferably from 1/100 to 10/100.

Suitable carriers for use in such two component developers include any known carrier materials such as iron powders, ferrite powders, magnetite powders, magnetic resin carriers, which have a particle diameter of from about 20 μm to about 200 μm. The surface of the carriers may be coated with a resin.

Specific preferred examples of such resins to be coated on the carriers include amino resins such as urea-formaldehyde resins, melamine resins, benzoguanamine resins, urea resins, and polyamide resins, and epoxy resins. In addition, polyvinyl or polyvinylidene resins such as acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins, polyester resins such as polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, fluoroterpolymers such as terpolymer of tetrafluoroethylene, vinylidenefluoride and other monomers including no fluorine atom, and silicone resins can be used.

If desired, an electroconductive powder may be included in the coating resin. Specific preferred examples of such electroconductive powders include metal powders, carbon blacks, titanium oxides, tin oxides, and zinc oxides. The average particle diameter of such electroconductive powders is preferably not greater than 1 μm. When the particle diameter is greater than 1 μm, it is hard to control the resistance thereof.

The toner of the present invention can also be used as a single component magnetic developer or a single component non-magnetic developer, which does not use a carrier.

Figure 2:
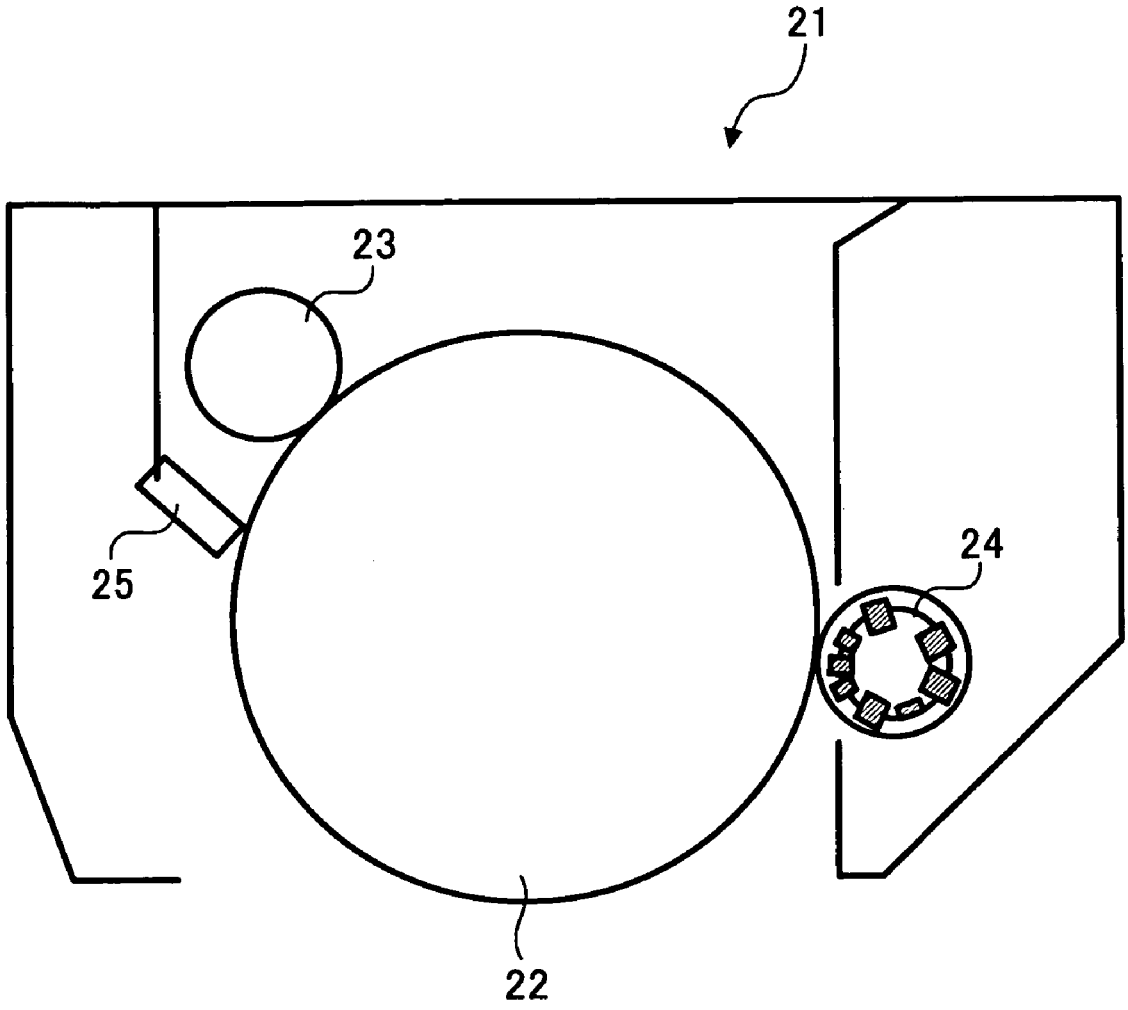
FIG. 2 is a schematic view illustrating the cross section of an embodiment of the process cartridge of the present invention.

FIG. 2 is a schematic view illustrating the cross section of an embodiment of the process cartridge of the present invention. Numeral 21 denotes a process cartridge. The process cartridge 21 includes a photoreceptor 22 serving as an image bearing member bearing an electrostatic latent image thereon, a charger 23 which charges the photoreceptor 22, a developing roller 24 serving as a member of a developing device which develops the electrostatic latent image on the photoreceptor 22 with the developer of the present invention to form a toner image on the photoreceptor 22, and a cleaning blade 25 which serves as a cleaner and which removes toner particles remaining on the surface of the photoreceptor 22 after the toner image on the photoreceptor 22 is transferred onto a receiving material (not shown).

The process cartridge is not limited to the process cartridge 21 illustrated in FIG. 2. Any process cartridges including at least an image bearing member and a developing device including the toner of the present invention can be used as the process cartridge of the present invention.

The process cartridge of the present invention is detachably set in an image forming apparatus. In the image forming apparatus in which the process cartridge is set, the photoreceptor 22 is rotated at a predetermined rotation speed. The photoreceptor 22 is charged with the charger 23 and thereby the photoreceptor 22 is uniformly charged positively or negatively. Then an image irradiating device (not shown) irradiates the charged surface of the photoreceptor 22 with light using a method such as slit irradiation methods and laser beam irradiation methods, resulting in formation of electrostatic latent image on the photoreceptor 22.

The thus prepared electrostatic latent image is developed by the developing roller 24 bearing the developer of the present invention thereon, resulting in formation of a toner image on the photoreceptor 22. The toner image is then transferred onto a receiving material (not shown) which is timely fed by a feeding device (not shown) to a transfer position between the photoreceptor 22 and a transfer device (not shown).

The toner image formed on the receiving material is then separated from the photoreceptor 22 and fixed by a heat/pressure fixing device (not shown) including a fixing roller. The fixed image is discharged from the image forming apparatus. Thus, a hard copy is produced.

The surface of the photoreceptor 22 is cleaned by the cleaning blade 25 to remove toner remaining on the photoreceptor 22, followed by discharging, to be ready for the next image forming operation.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

(Synthesis of Toner Binder)

The following components were contained in a reaction container having a condenser, a stirrer and a nitrogen introducing tube and reacted for 8 hours at 230° C. under normal pressure.

| | |
|---|---|
| Adduct of bisphenol A with 2 moles of ethylene oxide | 724 |
| Isophthalic acid | 276 |
| Dibutyl tin oxide | 2 |

Then the reaction was further continued for 5 hours under a reduced pressure of from 10 to 15 mmHg. Subsequent to cooling down to 160° C., 32 parts of phthalic anhydride were added thereto to perform a reaction for 2 hours. Subsequent to cooling down to 80° C., 188 parts of isophorone diisocyanate were added thereto in ethyl acetate to react for 2 hours. Thus, a prepolymer (1) containing an isocyanate group was prepared. Then 267 parts of the prepolymer (1) and 14 parts of isophorone diamine were reacted for 2 hours at 50° C. Thus, a urea-modified polyester (1) was prepared. The urea-modified polyester (1) had a weight average molecular weight of 64000.

Similarly, 724 parts of adduct of bisphenol A with 2 mole ethylene oxide and 276 parts of terephthalic acid were reacted for 8 hours at 230° C. under normal pressure to perform polycondensation. Then the reaction was further continued for 5 hours under a reduced pressure of from 10 to 15 mmHg. Thus an unmodified polyester (a) was obtained. The unmodified polyester (a) had a peak molecular weight of 5000. Two hundred parts of the urea-modified polyester (1) and 800 parts of the unmodified polyester (a) were dissolved and mixed in 2000 parts of a mixture solvent of ethyl acetate/methyl ethyl ketone (1/1). Thus, an ethyl acetate/methyl ethyl ketone solution of the toner binder (1) was obtained. A portion of the solution was dried under a reduced pressure to isolate the toner binder (1). The toner binder (1) had a Tg of 62° C. and an acid value of 10 mgKOH/g.

(Manufacturing of Toner)

The following components were placed in a beaker and stirred at 60° C. by a TK type HOMOMIXER at 12000 rpm to be uniformly dissolved and dispersed.

| | |
|---|---|
| Ethyl acetate/methyl ethyl ketone solution of the toner binder (1) mentioned above | 240 |
| Pentaerythritol tetrabehenate (melting point of 81° C., fusing viscosity of 25 cps) | 20 |
| Carbon black (PH of 4.5) | 10 |

Further, 706 parts of ion exchanged water, 294 parts of 10% hydroxyapatite suspension (SUPERTITE 10 from Nippon Chemical Industrial Co., Ltd) and 0.2 parts of dodecyl benzene sulphonic sodium were contained in a beaker to prepare a dispersion. The dispersion was heated to 60° C., and then stirred with a TK HOMOMIXER at 12000 rpm. Then adding the toner material liquid prepared above was added thereto. After stirring for 10 minutes, the mixture was moved to a flask having a stirrer and a thermometer and heated to 98° C. to remove the solvent therein. After filtering, washing and drying, the resultant powder was subjected to air separating. Thus mother toner particles were obtained with a volume average particle diameter (Dv) of 6.1 μm, a number average particle diameter (Dp) of 5.2 μm, Dv/Dp of 1.17 and volume resistivity of 10.6 (LogΩcm).

Further, 100 parts of the mother toner particles, 0.5 parts of a hydrophobic silica and 0.5 parts of a hydrophobic titanium oxide were mixed with a HENSCHEL MIXER and thus the toner (1) of the present invention was obtained. The estimated results are shown in Table 1.

Example 2

(Synthesis of Toner Binder)

The following components were subjected to polycondensation in the same way as in Example 1.

| | |
|---|---|
| Adduct of bisphenol A with 2 moles of ethylene oxide | 334 |
| Adduct of bisphenol A with 2 moles of propylene oxide | 334 |
| Isophthalic acid | 274 |
| Trimellitic acid anhydride | 20 |

Then 154 parts of isophoron diisocyanate were added and reacted to obtain a prepolymer (2). Further, 213 parts of the prepolymer (2), 9.5 parts of isophoron diamine and 0.5 parts of dibutyl amine were reacted in the same way as in Example 1 and thus a urea-modified polyester (2) having a weight average molecular weight of 79000 was obtained. Two hundred parts of the urea-modified polyester (2) and 800 parts of the unmodified polyester (a) were dissolved and mixed in 2000 parts of a mixture solvent of ethyl acetate/methyl ethyl ketone (1/1) and thus an ethyl acetate solution of the toner binder (2) was obtained. A portion of the solution was dried under a reduced pressure to isolate the toner binder (2). The toner binder (2) has a peak molecular weight of 5000, a Tg of 62° C. and an acid value of 10 mgKOH/g.

(Manufacturing of Toner)

The toner (2) of the present invention was obtained in the same manner as in Example 1 except that the temperature of dissolution and dispersion was changed to 50° C. The mother particle of the toner had a volume average particle diameter (Dv) of 5.4 μm, a number average particle diameter (Dp) of 4.6 μm and Dv/Dp of 1.17. The results are shown in Table 1.

Comparative Example 1

(Synthesis of Toner Binder)

The same toner binder as in Example 1 was used.

(Manufacturing of Toner)

A toner was prepared in the same manner as in Example 1 except that carbon black having a PH of 8.5 was used instead of the carbon black used in Example 1. The obtained comparative toner (1) had a volume average particle diameter of 6 μm. The mother toner particles had a volume average particle diameter (Dv) of 6.2 μm, a number average particle diameter (Dp) of 5.1 μm and Dv/Dp of 1.22. The results are shown in Table 1.

TABLE 1

| Toner No. | Fluidity | Minimum fixing temperature | Hot offset | Volume resistivity | Amount of charge (−μc/g) At start | After 30000 prints |
|---|---|---|---|---|---|---|
| Example 1 | 0.41 | 135° C. | 220° C. | 10.7 | 22 | 20 |
| Example 2 | 0.40 | 145° C. | Not lower than 230° C. | 10.8 | 21 | 19 |
| Comparative Example 1 | 0.39 | 130° C. | 220° C. | 9.6 | 16 | 8 |

Example 3

(Synthesis of Toner Binder)

Thirty parts of the urea-modified polyester (1) and 970 parts of the unmodified polyester (a) were dissolved and mixed in 2000 parts of a mixture solvent of ethyl acetate/methyl ethyl ketone (1/1) and thus an ethyl acetate/methyl ethyl ketone solution of a toner binder (3) was obtained. A portion of the solution was dried under a reduced pressure to isolate the toner binder (3). The toner binder (3) had a peak molecular weight of 5000, a Tg of 62° C. and an acid value of 10 mgKOH/g.

(Manufacturing of Toner)

A toner (3) according to the present invention was obtained in the same manner as in Example 2 except that the toner binder (2) was replaced by the toner binder (3) and the addition amount of carbon black was changed to 8 parts. The mother toner particles had a volume average particle diameter (Dv) of 5.7 μm, a number average particle diameter (Dp) of 4.8 μm and Dv/Dp of 1.19. The results are shown in Table 2.

Example 4

(Synthesis of Toner Binder)

Five hundred parts of the urea-modified polyester (1) and 500 parts of the unmodified polyester (a) were dissolved and mixed in 2000 parts of a mixture solvent of ethyl acetate/methyl ethyl ketone (1/1) and thus an ethyl acetate/methyl ethyl ketone solution of a toner binder (4) was obtained. A portion of the solution was dried under a reduced pressure to isolate the toner binder (4). The toner binder (4) had a peak molecular weight of 5000, a Tg of 62° C. and an acid value of 10 mgKOH/g.

(Manufacturing of Toner)

A toner (4) according to the present invention was obtained in the same manner as in Example 1 except that the toner binder (1) in Example 1 was replaced by the toner binder (4) and the addition amount of carbon black was changed to 8 parts. The mother toner particles had a volume average particle diameter (Dv) of 6.5 μm, a number average particle diameter (Dp) of 5.5 μm and Dv/Dp of 1.18. The results are shown in Table 2.

Comparative Example 2

(Synthesis of Toner Binder)

The following components were contained in a reaction container having a condenser, a stirrer and a nitrogen introducing tube and reacted for 8 hours at 230° C. under normal pressure.

| | |
|---|---|
| Adduct of bisphenol A with 2 moles of ethylene oxide | 343 |
| Isophthalic acid | 166 |
| Dibutyl tin oxide | 2 |

Then the reaction was further continued for 5 hours under a reduced pressure of from 10 to 15 mmHg. Subsequent to cooling down to 80° C., 14 parts of toluene diisocyanate were added thereto in the presence of toluene and reacted for 5 hours at 110° C. After the solvent thereof was removed, a urethane modified polyester having a molecular weight of 98000 was obtained. Similar to Example 1, 363 parts of adduct of 2 mole ethylene oxide with bisphenol A and 166 parts of isophthalic acid were subjected to polycondensation. Thus, an unmodified polyester having a peak molecular weight of 3800 and an acid value of 7 mgKOH/g was obtained. Three hundred and fifty parts of the urethane-modified polyester and 650 parts of the unmodified polyester mentioned above were dissolved and mixed in toluene. After removing the solvent thereof, a comparative toner binder (2) was obtained. The comparative toner binder (2) had a Tg of 58° C.

(Manufacturing of Toner)

A toner was obtained using 100 parts of the comparative toner binder (2) and 8 parts of carbon black having a pH of 0.6 according to the following method. Preparatory mixing was performed using a HENSCHEL MIXER followed by kneading with a continuous kneading machine. Then the mixture was finely pulverized using a jet mill and classified by an air separator to obtain mother toner particles. Further 100 parts of the mother toner particle, 0.5 parts of hydrophobic silica and 0.5 parts of hydrophobic titanium oxide were mixed with a HENSCHEL MIXER and thus a comparative toner (2) was obtained. The mother toner particles had a volume average particle diameter (Dv) of 7.0 μm, a number average particle diameter (Dp) of 5.2 μm and Dv/Dp of 1.35. The estimated results are shown in Table 2.

TABLE 2

| Toner No. | Fluidity | Minimum fixing temperature | Hot offset | Volume resistivity | Amount of charge (−μc/g) At start | After 30000 prints |
|---|---|---|---|---|---|---|
| Example 3 | 0.41 | 120° C. | 230° C. | 11.2 | 20 | 18 |
| Example 4 | 0.42 | 120° C. | 230° C. | 11.1 | 21 | 19 |
| Comparative Example 2 | 0.30 | 130° C. | 220° C. | 19 | 19 | 10 |

Example 5

(Manufacturing of Toner Binder)

Seven hundred and fifty parts of the urea-modified polyester (1) and 250 parts of the unmodified polyester (a) were dissolved and mixed in 2000 parts of a mixture solvent of ethyl acetate/methyl ethyl ketone (1/1) and thus an ethyl acetate/methyl ethyl ketone solution of a toner binder (5) was obtained. A portion of the solution was dried under a reduced pressure to isolate the toner binder (5). The toner binder (5) had a peak molecular weight of 5000, a Tg of 62° C. and an acid value of 10 mgKOH/g.

A toner was obtained in the same manner as in Example 1 except that the toner binder (1) was replaced with the toner binder (5). The mother toner particles had a volume average particle diameter (Dv) of 4.4 μm, a number average particle diameter (Dp) of 3.6 μm and Dv/Dp of 1.22. The results are shown in Table 3.

Example 6

(Manufacturing of Toner Binder)

Eight hundred and fifty parts of the urea-modified polyester (1) and 150 parts of the unmodified polyester (a) were dissolved and mixed in 2000 parts of a mixture solvent of ethyl acetate/methyl ethyl ketone (1/1) and thus an ethyl acetate/methyl ethyl ketone solution of a toner binder (6) was obtained. A portion of the solution was dried under a reduced pressure to isolate the toner binder (6). The toner binder (6) had a peak molecular weight of 5000, a Tg of 62° C. and an acid value of 10 mgKOH/g.

A toner was obtained in the same manner as in Example 1 except that the toner binder (1) was replaced with the toner binder (6). The mother toner particles had a volume average particle diameter (Dv) of 5.8 μm, a number average particle diameter (Dp) of 4.8 μm and Dv/Dp of 1.21. The results are shown in Table 3.

Comparative Example 3

(Synthesis of Toner Binder)

Three hundred and fifty four parts of adduct of bisphenol A with 2 moles of ethylene oxide and 166 parts of terephthalic acid were reacted to perform polycondensation using 2 parts of dibutyl tin oxide as a catalyst. Thus, a comparative toner binder (3) having a peak molecular weight of 12000, a Tg of 62° C. and an acid value of 10 mgKOH/g was obtained.

(Manufacturing Example of Toner)

The following components were contained in a beaker and stirred at 50° C. by a TK HOMOMIXER at 12000 rpm to be uniformly dissolved and dispersed.

| | |
|---|---|
| Comparative toner binder (3) mentioned above | 100 |
| Ethyl acetate | 200 |
| Carbon black (pH of 7.5) | 10 |

Thus a comparative toner material liquid was obtained. Then the procedure for preparation of the toner in Example 5 was repeated except that the toner material liquid was replaced with the comparative toner material liquid prepared above. The mother toner particles had a volume average particle diameter (Dv) of 6.5 μm, a number average particle diameter (Dp) of 5.1 μm and Dv/Dp of 1.27. The results are shown in Table 3.

TABLE 3

| Toner No. | Fluidity | Minimum fixing temperature | Hot offset | Volume resistivity | Amount of charge (−μc/g) At start | After 30000 prints |
|---|---|---|---|---|---|---|
| Example 5 | 0.41 | 150° C. | 230° C. | 10.9 | 20 | 19 |
| Example 6 | 0.42 | 145° C. | 230° C. | 10.8 | 22 | 18 |
| Comparative Example 3 | 0.31 | 130° C. | 160° C. | 10.7 | 20 | 10 |

Example 7

(Synthesis of Toner Binder)

The following components were reacted to perform polycondensation for 2 hours at 230° C. under normal pressure.

| | |
|---|---|
| Adduct of 2 moles of ethylene oxide with bisphenol A | 724 |
| Terephthalic acid | 276 |

Then the reaction was further continued for 5 hours under a reduced pressure of from 10 to 15 mmHg and thus an unmodified polyester (b) having a peak molecular weight of 800 was obtained. Two hundred parts of the urea-modified polyester (1) and 800 parts of the unmodified polyester (b) were dissolved and mixed in 2000 parts of a mixture solvent of ethyl acetate/methyl ethyl ketone (1/1) and thus an ethyl acetate/methyl ethyl ketone (1/1) solution of a toner binder (7) was obtained. A portion of the solution was dried under a reduced pressure to isolate the toner binder (7). The toner binder (7) had a Tg of 45° C.

(Manufacturing of Toner)

A toner (7) was obtained in the same manner as in Example 1 except that the toner binder (1) was replaced with the toner binder (7). The mother toner particles had a volume average particle diameter (Dv) of 6.4 μm, a number average particle diameter (Dp) of 5.4 μm and Dv/Dp of 1.19. The results are shown in Table 4.

Example 8

(Synthesis of Toner Binder)

The following components were reacted to perform polycondensation for 4 hours at 230° C. under normal pressure.

| | |
|---|---|
| Adduct of 2 moles of ethylene oxide with bisphenol A | 724 |
| Terephthalic acid | 276 |

Then the reaction was further continued for 5 hours under a reduced pressure of from 10 to 15 mmHg and thus an unmodified polyester (c) having a peak molecular weight of 2000 was obtained. Two hundred parts of the urea-modified polyester (1) and 800 parts of the unmodified polyester (c) were dissolved and mixed in 2000 parts of a mixture solvent of ethyl acetate/methyl ethyl ketone (1/1) and thus an ethyl acetate/methyl ethyl ketone (1/1) solution of a toner binder (8) was obtained. A portion of the solution was dried under a reduced pressure to isolate the toner binder (8). The toner binder (8) had a Tg of 52° C.

(Manufacturing of Toner)

A toner (8) was obtained in the same manner as in Example 1 except that the toner binder (1) was replaced with the toner binder (8). The mother toner particles had a volume average particle diameter (Dv) of 5.6 μm, a number average particle diameter (Dp) of 4.9 μm and Dv/Dp of 1.14. The results are shown in Table 4.

Example 9

(Synthesis of Toner Binder)

The following components were reacted to perform polycondensation for 10 hours at 230° C. under normal pressure.

| | |
|---|---|
| Adduct of bisphenol A with 2 moles of ethylene oxide | 724 |
| Terephthalic acid | 276 |

Then the reaction was further continued for 5 hours under a reduced pressure of from 10 to 15 mmHg and thus an unmodified polyester (d) having a peak molecular weight of 30000 was obtained. Two hundred parts of the urea-modified polyester (1) and 800 parts of the unmodified polyester (d) were dissolved and mixed in 2000 parts of a mixture solvent of ethyl acetate/methyl ethyl ketone (1/1) and thus an ethyl acetate/methyl ethyl ketone (1/1) solution of a toner binder (9) was obtained. A portion of the solution was dried under a reduced pressure to isolate the toner binder (9). The toner binder (9) had a Tg of 69° C.

(Manufacturing of Toner)

A toner (9) was obtained in the same manner as in Example 1 except that the toner binder (1) was replaced with the toner binder (9). The mother toner particles of the obtained toner had a volume average particle diameter (Dv) of 6.7 μm, a number average particle diameter (Dp) of 6.2 μm and Dv/Dp of 1.08. The results are shown in Table 4.

TABLE 4

| | | | | | Amount of charge (−μc/g) | |
|---|---|---|---|---|---|---|
| Toner No. | Fluidity | Minimum fixing temperature | Hot offset | Volume resistivity | At start | After 30000 prints |
| Example 7 | 0.40 | 140° C. | 220° C. | 10.8 | 23 | 21 |
| Example 8 | 0.40 | 150° C. | 230° C. | 10.7 | 21 | 19 |
| Example 9 | 0.36 | 150° C. | 230° C. | 10.9 | 25 | 26 |

[Evaluation Method for Characteristics]

<Toner Particle Diameter>

The particle diameter (i.e., volume average particle diameter and number average particle diameter) of a toner was measured with a particle diameter measuring instrument, COULTER COUNTER TA II, manufactured by Coulter Electronics, Inc.

<Fluidity>

Bulk density of a toner was measured with a powder tester, manufactured by Hosokawa Micron Ltd. The larger bulk density a toner has, the better fluidity the toner has.

<Amount of Charge>

Five parts of a toner and 95 parts of the carrier described below were mixed with a blender for 10 minutes to obtain a developer.

(Carrier)

Core material: Spherical ferrite particle having an average particle diameter of 50 μm.

Coating liquid: A toluene solution of a silicone resin in which an amino silane coupling agent was dispersed.

The coating liquid was spray-coated on the core material in a heated state. The coated carrier was baked and then cooled down. Thus a film resin having an average thickness of 0.2 μm was formed on the core material, to give a coated carrier.

The amount of charge of a developer was measured by a blow-off method using an electrometer. In addition, the developer was installed in PRETER 650 from Ricoh Co., Ltd., and the amount of charge thereof was measured after 30000 prints.

In order to produce good images without background fouling caused by reversely charged toner particles, the amount of charge of the developer preferably falls within the range of from about 15 to about 25 (μc/g) in absolute figure.

<Hot Offset Temperature>

Each toner was placed in a commercial color copier (PRETER 550 from Ricoh Co., Ltd.) to produce images while changing the fixing temperature. The produced images were visually observed to determine whether hot offset occurs.

Hot offset temperature was defined as a minimum temperature of the fixing roll above which hot offset occurred.

<Minimum Fixing Temperature>

A copying test was performed using a paper TYPE 6200 manufactured by Ricoh Co., Ltd. and a copier MF-200 from Ricoh Co., Ltd. which is modified such that a TEFLON roller is used as a fixing roller while changing the fixing temperature. Produced images were rubbed to determine the image density remaining ratio defined by the following equation: Image density remaining ratio=$ID_a/ID_b$, wherein $ID_a$ and $ID_b$ represent the image densities of an image after and before the rubbing, respectively. The minimum fixing temperature was defined as a temperature of the fixing roller above which the image density remaining ratio was not less than 70%.

<Volume Resistivity>

(1) A toner pellet was prepared by a method in which 3 grams of a toner are contained in a cylinder having an inside diameter of 4 cm and pressed at 6t/cm$^2$ for 1 minute using an electric pressing machine, manufactured by Maekawa Testing Co., Ltd.

(2) Volume resistivity of the pellet was measured using a dielectric loss measuring device, i.e., TR-10C type, manufactured by Ando Electric Co., Ltd.

[Measuring Condition]

Frequency: 1 KHz

Ratio: $1\times1/10^9$

[Mathematical Formula 1]

Volume resistivity [log (Ωcm)=log $\{(A\times100)/Ratio\times(R-R_0)\times t\}$, wherein t represents a thickness of the sample in mm, A represents an effective electrode area in cm$^2$, $R_0$ represent a conductance at zero adjustment in S, and R represents a conductance at measurement in S.

According to the present invention, a dry toner can be provided which has a small diameter and high electric resistance and is excellent in fluidity, transferability, high temperature preservability, low temperature fixability and hot offset resistance.

In addition, a developer using the dry toner, and an image forming method and apparatus which can produce images having good low temperature fixability and hot offset resistance for a long period of time can be provided.

Further, a process cartridge using the dry toner mentioned above which can produce quality images can also be provided.

This document claims priority and contains subject matter related to Japanese Patent Application No. JP2002-347478, filed on Nov. 29, 2002, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A dry toner prepared by a method comprising:

(A) dissolving or dispersing a toner composition in an organic solvent to prepare a toner composition liquid; and (B) dispersing the toner composition liquid in an aqueous liquid to form a dispersion, wherein the dispersion comprises:

a binder resin comprising a modified polyester (i); and a colorant comprising a carbon black, wherein the carbon black has a pH not greater than 7, wherein the toner has a volume average particle diameter (Dv) of from 3 to 7 μm and a ratio (Dv/Dp) of the volume average particle diameter (Dv) to a number average particle diameter (Dp) of from 1.00 to 1.25, wherein the toner has a spindle shape;

wherein the binder resin further comprises an unmodified polyester (ii);

wherein the unmodified polyester (ii) has a peak molecular weight of from 1000 to 30000; and wherein the unmodified polyester (ii) has a glass transition temperature (Tg) of from 35 to 55° C.

2. The dry toner according to claim 1, wherein the toner composition comprises a prepolymer and wherein the modified polyester (i) is formed by the prepolymer in either or both of steps (A) and (B).

3. The dry toner according to claim 1, wherein the colorant is a master batch in which the carbon black is dispersed in a master batch resin.

4. The dry toner according to claim 3, wherein the master batch resin is a polyester resin.

5. The dry toner according to claim 1, wherein a weight ratio (i/ii) of the modified polyester (i) to the unmodified polyester (ii) is from 5/95 to 80/20.

6. The dry toner according to claim 1, wherein the unmodified polyester (ii) has an acid value of from 1 to 15 mgKOH/g.

7. The dry toner according to claim 1, wherein the spindle shape has a ratio (r2/r1) of a minor axis particle diameter (r2) to a major axis particle diameter (r1) of from 0.5 to 0.8 and has a ratio (r3/r2) of a thickness (r3) to the minor axis particle diameter (r2) of from 0.7 to 1.0.

8. A two-component developer comprising the dry toner according to claim 1 and a carrier.

9. A toner container having therein the dry toner according to claim 1.

10. A dry toner comprising toner particles comprising:

a binder resin comprising a modified polyester resin; and a colorant comprising a carbon black, wherein the carbon black has a pH not greater than 7, wherein the toner has a volume average particle diameter (Dv) of from 3 to 7 μm and a ratio (Dv/Dp) of the volume average particle diameter (Dv) to a number average particle diameter (Dp) of from 1.00 to 1.25, wherein the toner has a spindle shape;

wherein the binder resin further comprises an unmodified polyester (ii);

wherein the unmodified polyester (ii) has a peak molecular weight of from 1000 to 30000; and wherein the unmodified polyester (ii) has a glass transition temperature (Tg) of from 35 to 55° C.

11. A method for manufacturing a toner composition comprising toner particles according to claim 10, comprising:

dissolving or dispersing a toner composition in an organic solvent to form a toner composition liquid;

dispersing the toner composition liquid in an aqueous liquid to prepare a dispersion;

wherein said dispersion comprises said binder resin comprising said modified polyester resin and said carbon black which has a pH of not greater than 7.

12. The dry toner according to claim 10, wherein a weight ratio (i/ii) of the modified polyester (i) to the unmodified polyester (ii) is from 5/95 to 80/20.

* * * * *